US007818832B2

(12) United States Patent
Hartenstine et al.

(10) Patent No.: US 7,818,832 B2
(45) Date of Patent: Oct. 26, 2010

(54) PLAY YARD WITH HEIGHT ADJUSTABLE BASSINET

(75) Inventors: Curtis M. Hartenstine, Birdsboro, PA (US); Nathanael Saint, Morgantown, PA (US); Ronald R. Hoffman, Morgantown, PA (US); Sharon A. Gillett, Salem, OR (US); Jonathan M. Pacella, Coatesville, PA (US); Derek A. King, Mukwonago, WI (US); Joseph F. Fiore, Jr., Lebanon, PA (US)

(73) Assignee: Wonderland Nurserygoods Co., Ltd., Neihu, Taipei (TW)

( * ) Notice: Subject to any disclaimer, the term of this patent is extended or adjusted under 35 U.S.C. 154(b) by 0 days.

(21) Appl. No.: 12/199,576

(22) Filed: Aug. 27, 2008

(65) Prior Publication Data

US 2009/0056013 A1 Mar. 5, 2009

Related U.S. Application Data

(60) Provisional application No. 60/966,679, filed on Aug. 29, 2007.

(51) Int. Cl.
*A47C 7/00* (2006.01)
*A47D 7/00* (2006.01)
*A47D 13/06* (2006.01)

(52) U.S. Cl. ..... 5/98.1; 5/93.1; 5/93.2

(58) Field of Classification Search ..... 5/93.1, 5/98.1, 99.1, 95

See application file for complete search history.

(56) References Cited

U.S. PATENT DOCUMENTS

| | | | | |
|---|---|---|---|---|
| 3,018,493 | A | 1/1962 | Wittbrodt | 5/99 |
| 5,339,470 | A | 8/1994 | Shamie | 5/98.1 |
| 5,349,709 | A | 9/1994 | Cheng | 5/93.1 |
| 5,615,427 | A | 4/1997 | Huang | 5/99.1 |
| 2004/0074000 | A1 | 4/2004 | Tharalson | 5/99.1 |
| 2004/0261174 | A1 * | 12/2004 | DeHart et al. | 5/93.1 |
| 2009/0049605 | A1 * | 2/2009 | Zhao et al. | 5/93.1 |
| 2009/0144896 | A1 * | 6/2009 | Chen et al. | 5/93.1 |

* cited by examiner

*Primary Examiner*—Peter M Cuomo
*Assistant Examiner*—Jonathan J Liu
(74) *Attorney, Agent, or Firm*—Miller Law Group, PLLC

(57) ABSTRACT

A play yard frame structure includes upper and lower horizontal frame members and vertical frame members with a fabric body that extends over the exterior of the frame structure. The fabric body has fastening tabs that extend from the corners of the fabric body corresponding to the vertical frame members to be passed through openings in the foot members for fastening to the foot members on a surface that is not on the exterior of the frame structure to provide a taut panel that extends around the lower perimeter of the play yard below the lower horizontal frame members. The bassinet structure includes a height adjustment feature that enables the floor surface of the bassinet structure to be positioned selectively at multiple height positions relative to the upper horizontal frame members. In one embodiment, the fabric walls of the bassinet include secondary frame tunnels for supporting the bassinet frame.

6 Claims, 5 Drawing Sheets

Fig. 2
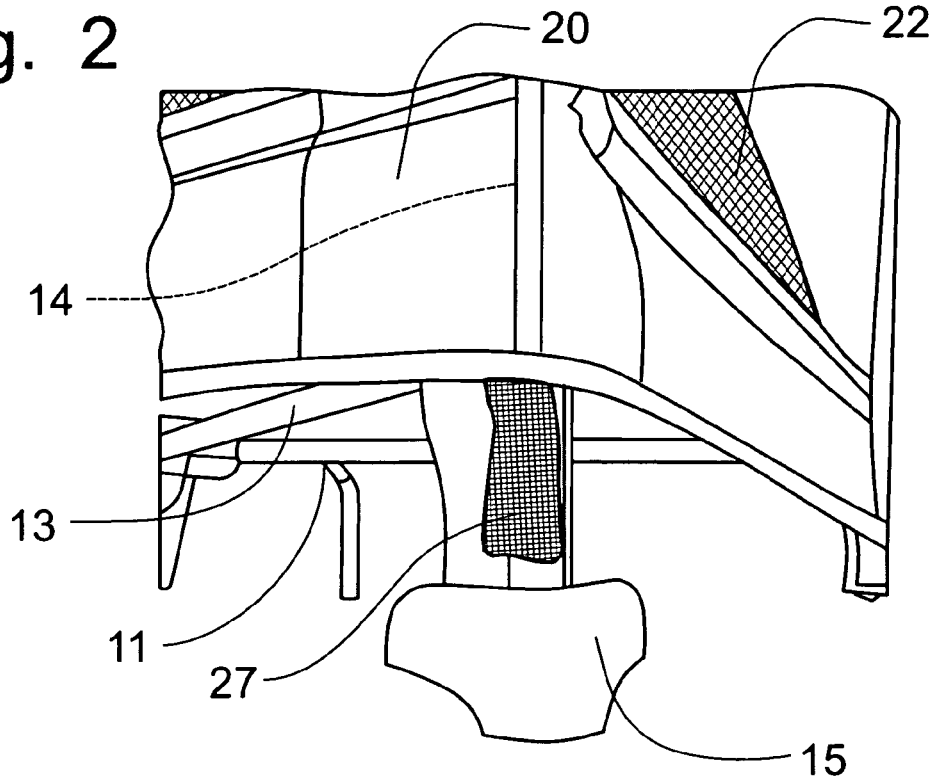
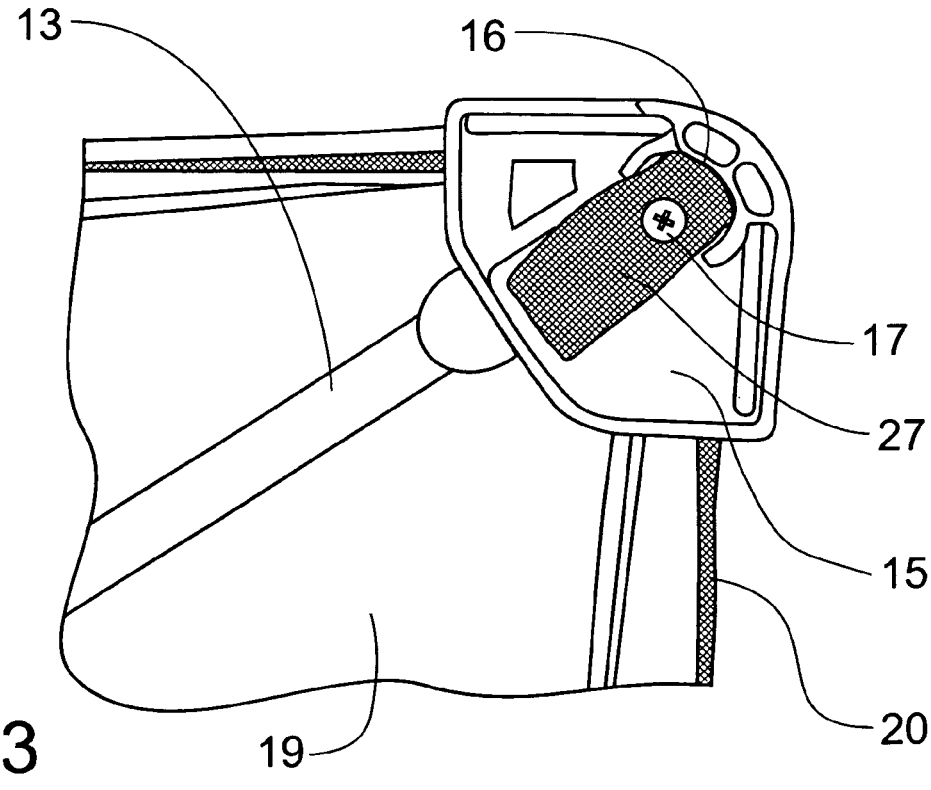
Fig. 3

PLAY YARD WITH HEIGHT ADJUSTABLE BASSINET

CROSS-REFERENCE TO RELATED APPLICATIONS

This application claims priority on U.S. Provisional Patent Application Ser. No. 60/966,679, filed on Aug. 29, 2007, the contents of which are incorporated herein by reference.

FIELD OF THE INVENTION

The present invention relates generally to a child's play yard enclosure and, more particularly, to a play yard having a bassinet attachment that can be positioned at a user selected height, and to a play yard having a lower fabric connection that provides a taut lower panel enclosure for the play yard adjacent the floor.

BACKGROUND OF THE INVENTION

Play yards are used to contain and provide a safe environment for a child for sleeping or playing. Typically, play yards are collapsible so they can be stored or transported easily. Currently, play yards are manufactured with a frame that consists of a combination of assembled metal and plastic components with a fabric body that wraps around the frame to provide an enclosure to retain the child within the play yard. Play yards can be equipped with a bassinet assembly that can be supported by the play yard frame to establish an enclosed sleep area at a higher level than the bottom floor surface of the play yard to provide an easy access to the child without requiring the caregiver to bend to access the floor of the play yard.

The fabric body typically includes mesh portions corresponding to the sides and ends of the play yard to facilitate viewing of a child within the play yard. The fabric body is typically supported on the upper horizontal frame members and is pulled downwardly therefrom over the vertical frame members to be supported on the lower frame members and fastened to the play yard frame by using a screw and a plastic cap over the screw fastener. Such a fabric body provides an open view of the underside of the play yard. Some play yards are then provided with an additional panel of fabric that hangs down from the lower horizontal frame members to provide a loose ruffle around the bottom of the play yard to hide the opening between the floor of the play yard and the floor on which the play yard is positioned.

In PCT Patent Application No. PCT/FR98/02219, published as WO99/20161 on Apr. 20, 1999, the play yard includes a fabric body that extends upwardly from the lower horizontal frame members of the play yard to loop over the upper horizontal frame members. The overlap of the fabric body at the top of the play yard is provided with corner pieces that extend downwardly from the overlap portion to secure to the vertical frame members. In U.S. Patent Application Publication No. 2004/0074000, filed by Douglas Tharalson, et al and published on Apr. 22, 2004, a fabric covering designed to be applied to an existing play yard, crib or other freestanding apparatus to convert the play yard into a storage facility for toys, etc. This fabric covering of Tharalson is not intended to be a fabric body of a play yard, but to be positioned on the outside of a play yard fabric body. This Tharalson fabric covering extends over the play yard floor, inner surfaces and outer surfaces and is fastened to through the mesh portion of the play yard fabric body and tied off against the foot members of the play yard.

Converting a play yard into a raised bassinet for a child to sleep while providing easy access to the sleeping child for the caregiver is known in the art, as is represented in U.S. Pat. No. 3,018,493, granted to Gertrude Wittbrodt on Jan. 30, 1962. In the Wittbrodt patent, the floor of the play pen is raised into an elevated position to form a bassinet structure by fastening a central canvas member around the upper horizontal frame supports of the play pen. Attaching the central canvas members to the upper frame members shortens the vertical walls of the fabric body to raise the floor of the play pen to bassinet height. The floor of the play pen in U.S. Pat. No. 5,339,470, issued to Louis Shamie on Aug. 23, 1994, is also elevated to establish a changing table from the play pen structure. The Shamie floor is temporarily supported on releasable clips that are supported from the upper horizontal frame members of the play pen.

In U.S. Pat. No. 5,349,709, issued to Ying-Hsiung Cheng on Sep. 27, 1994, a separate floor frame is provided to permit the selective mounting of the floor frame to the upper horizontal frame members of the play yard to position the floor of the play yard at either a raised position, which could be utilized for a bassinet or a changing table, or a lowered position, which would provide the conventional floor of a play yard. An independent frame structure to establish a raised inner play yard structure, which has an elevated floor compared to the location of the floor for the outer play yard structure, is disclosed in U.S. Pat. No. 5,615,427, granted on Apr. 1, 1997, to Li-chu Huang. The elevated inner play yard could be utilized as a bassinet or as a changing table. None of these known prior art references, however, provides for a variably positionable bassinet structure, one in which the floor portion of the bassinet can be selectively located at adjustable heights to establish an extended period of use for the bassinet structure for older infants.

It would be desirable to provide a high chair structure that establishes a taut fabric enclosure around the play yard frame from the upper frame members of the play yard to the floor on which the play yard is positioned to hide the opening between the lower horizontal frame members of the play yard and the building floor. It would also be desirable to provide a bassinet structure that could be utilized to adjust the height of the bassinet relative to the upper horizontal frame members of the play yard.

SUMMARY OF THE INVENTION

It is an object of this invention to provide a fabric body for a child's play yard structure that covers the area between the lower horizontal frame members and the support surface on which the play yard is located.

It is a feature of this invention that the fabric body for the play yard extends downwardly from the upper horizontal play yard frame members over the outside of the vertical play yard frame members to the underlying support surface on which the play yard is positioned.

It is another feature of this invention that the fabric body includes a fastening tab at each corner of the fabric body, corresponding to the vertical play yard frame members.

It is an advantage of this invention that the fastening tabs can be inserted through openings formed in the foot members of the play yard to be attached to the foot members by a fastener inserted into a surface of each respective foot members that is not on the exterior side of the foot member.

It is another advantage of this invention that the attachment of the fastening tab permits the fabric body to be pulled taut along the entire exterior surface of the play yard to the support surface on which the play yard is positioned.

It is another object of this invention to provide a play yard fabric body that has a taut panel located below the lower horizontal frame members of the play yard that extends to the support surface on which the play yard is positioned.

It is still another object of this invention to provide an adjustable height bassinet structure for the play yard.

It is still another feature of this invention that the bassinet structure includes a separate frame that is supported from the play yard frame structure.

It is yet another feature of this invention that the fabric walls of the bassinet structure incorporate at least one frame tunnel intermediate an upper frame tunnel and the floor member of the bassinet.

It is still another advantage of this invention that the adjustable height bassinet structure provides an extended use of the bassinet structure by providing an adjustable positioning of the bassinet floor relative to the upper horizontal play yard frame members.

It is yet another advantage of this invention that the use of a bassinet structure for a play yard can be extended beyond the time an infant is able to roll over by itself.

It is a further advantage of this invention that the higher side walls of a lowered adjustable height bassinet structure provides a safe environment for a growing infant.

It is yet another object of this invention to provide a play yard structure incorporating an adjustable height bassinet structure and a fabric body attachment system that provides a taut panel below the lower horizontal frame members of the play yard that is durable in construction, inexpensive of manufacture, carefree of maintenance, facile in assemblage, and simple and effective in use.

These and other objects, features and advantages are accomplished according to the instant invention by providing a play yard having a frame structure including upper and lower horizontal frame members and vertical frame members with a fabric body that extends over the exterior of the frame structure. The fabric body has fastening tabs that extend from the corners of the fabric body corresponding to the vertical frame members to be passed through openings in the foot members for fastening to the foot members on a surface that is not on the exterior of the frame structure to provide a taut panel that extends around the lower perimeter of the play yard below the lower horizontal frame members. The bassinet structure includes a height adjustment feature that enables the floor surface of the bassinet structure to be positioned selectively at multiple height positions relative to the upper horizontal frame members. In one embodiment, the fabric walls of the bassinet include secondary frame tunnels for supporting the bassinet frame.

BRIEF DESCRIPTION OF THE DRAWINGS

The advantages of this invention will be apparent upon consideration of the following detailed disclosure of the invention, especially when taken in conjunction with the accompanying drawings wherein:

FIG. 2 is an enlarged perspective view of the fabric body showing one of the fastening tabs for attaching the fabric body to the play yard frame structure, the fastening tab being detached from the play yard frame structure and pulled upwardly above the foot member;

FIG. 3 is an enlarged bottom plan view of a foot member of the play yard showing the attachment of the fastening tab to the underside of the foot member by a screw fastener;

DETAILED DESCRIPTION OF THE PREFERRED EMBODIMENT

Figure 1:
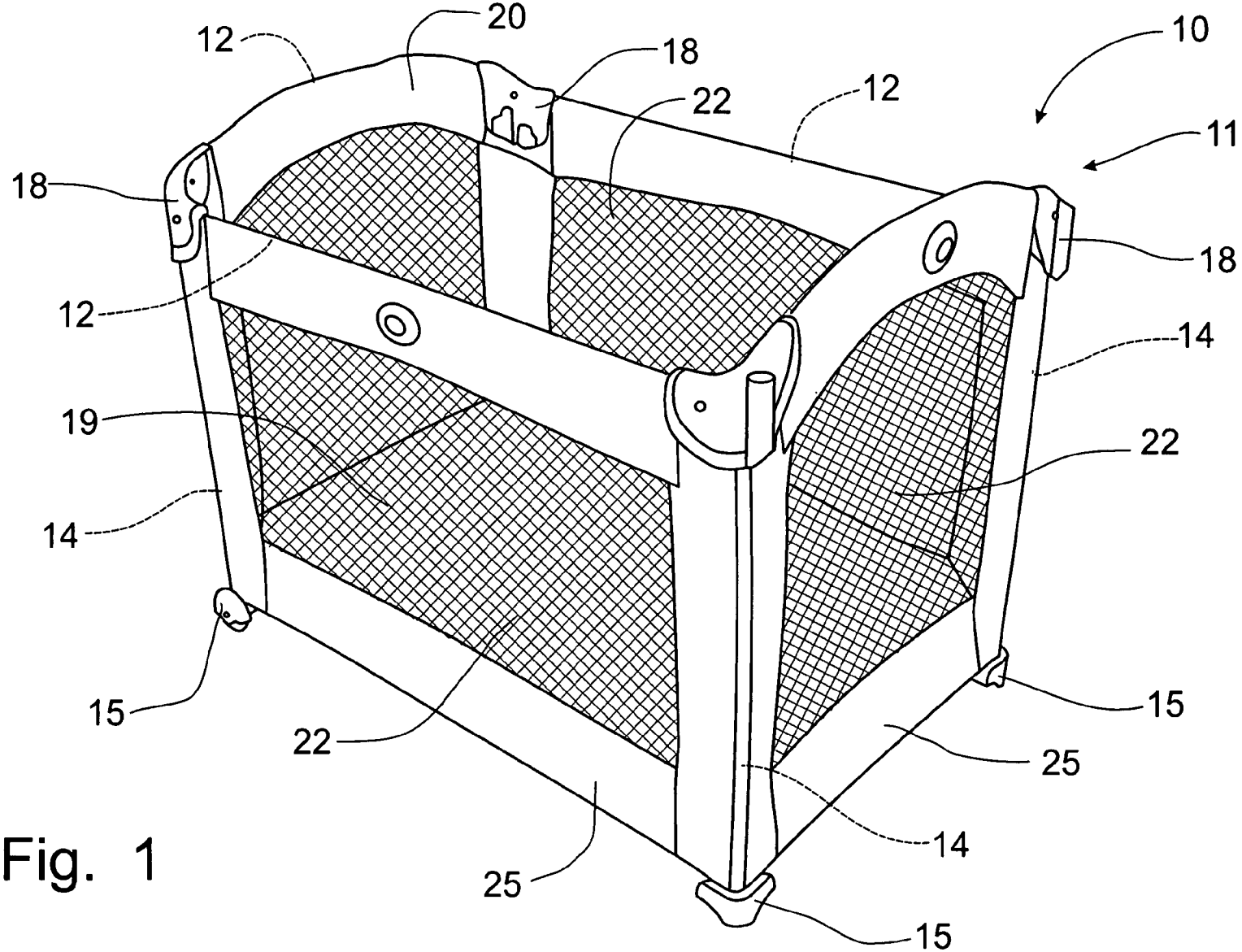
FIG. 1 is a perspective view of a play yard having a fabric body incorporating the principles of the instant invention.

Referring now to FIGS. 1-3, a child play yard incorporating the principles of the instant invention can best be seen. The play yard 10 incorporates a frame structure 11 that is covered by the fabric body 20, but includes upper horizontal frame members 12 defining a generally rectangular shape around the top of the play yard 10, lower horizontal frame members 13 positioned below the upper frame members 12 and providing a rectangular support for the floor member 19 of the play yard 10, and vertical frame members 14 interconnecting the upper and lower horizontal frame members 12, 13 and defining the corners of the play yard 10. The vertical frame members 14 terminate in respective foot members 15 that are attached to the vertical frame members 14 to engage the floor support surface on which the play yard is disposed. The lower horizontal frame members 14 are elevated above the support surface to define a space between the floor 19 and the support surface.

The fabric body 20 forms an enclosure around the periphery of the play yard 10. The fabric body 20 is preferably formed with an upper tunnel through which the upper horizontal frame members 12 are placed to support the upper portion of the fabric body. The fabric body 20 is then drawn taut around the vertical frame members 14 and the lower horizontal frame members 13 and secured, as will be described in greater detail below. The fabric body preferably includes generally vertical mesh portions 22 to facilitate viewing a child positioned on the play yard floor 19. The fabric body 20, according to the principles of the instant invention, also includes a lower panel 25 that is pulled taut around the bottom perimeter of the fabric body 20 below the lower horizontal frame members 13.

As best seen in FIGS. 2 and 3, the corners of the fabric body 20, corresponding to the vertical frame members 14, are formed with an attachment tab 27 that projects below the perimeter of the fabric body 20. Each of the foot members 15 is formed with a vertically oriented slot 16 that opens upwardly so that the attachment tab 27 can pass downwardly through the foot member 15 to pull the fabric body 20 down to the foot member 15. The attachment tab 27 can then be secured to the underside of the foot member 15 by a screw fastener 17. The connection of the attachment tab 27 to a surface that is not on the exterior of the frame structure 11 enables the fabric body 20 to be pulled downward the foot member 15, which is well below the level of the lower frame members 13. One skilled in the art will recognize that other attachment configurations can be utilized, other than placing the screw fastener 17 on the underside of the foot member 15. For example, the foot member can be configured to allow the attachment tab 27 to be wrapped around a surface (not shown) on the foot member to be secured on the inside of either the foot member 15 or the vertical frame member 14, which would allow the fabric body to be pulled taut down to the foot member 15.

Securing the attachment tab 27 so that the fabric body 20 is pulled taut around the vertical frame members 14 enables the fabric body 20 to be formed with a lower panel 25 that becomes located below the lower horizontal frame members 14 to cover the space between the lower horizontal frame members 13 and the support surface on which the play yard 10 is positioned. This lower panel 25 can be formed such that the lower panel 25 is pulled taut when the fabric body 20 is stretched downwardly from the upper horizontal frame members 12 over the vertical frame members 14. Furthermore, the taut fabric body 20 enables the mesh portions 22 to be pulled taut as well.

Figure 4:
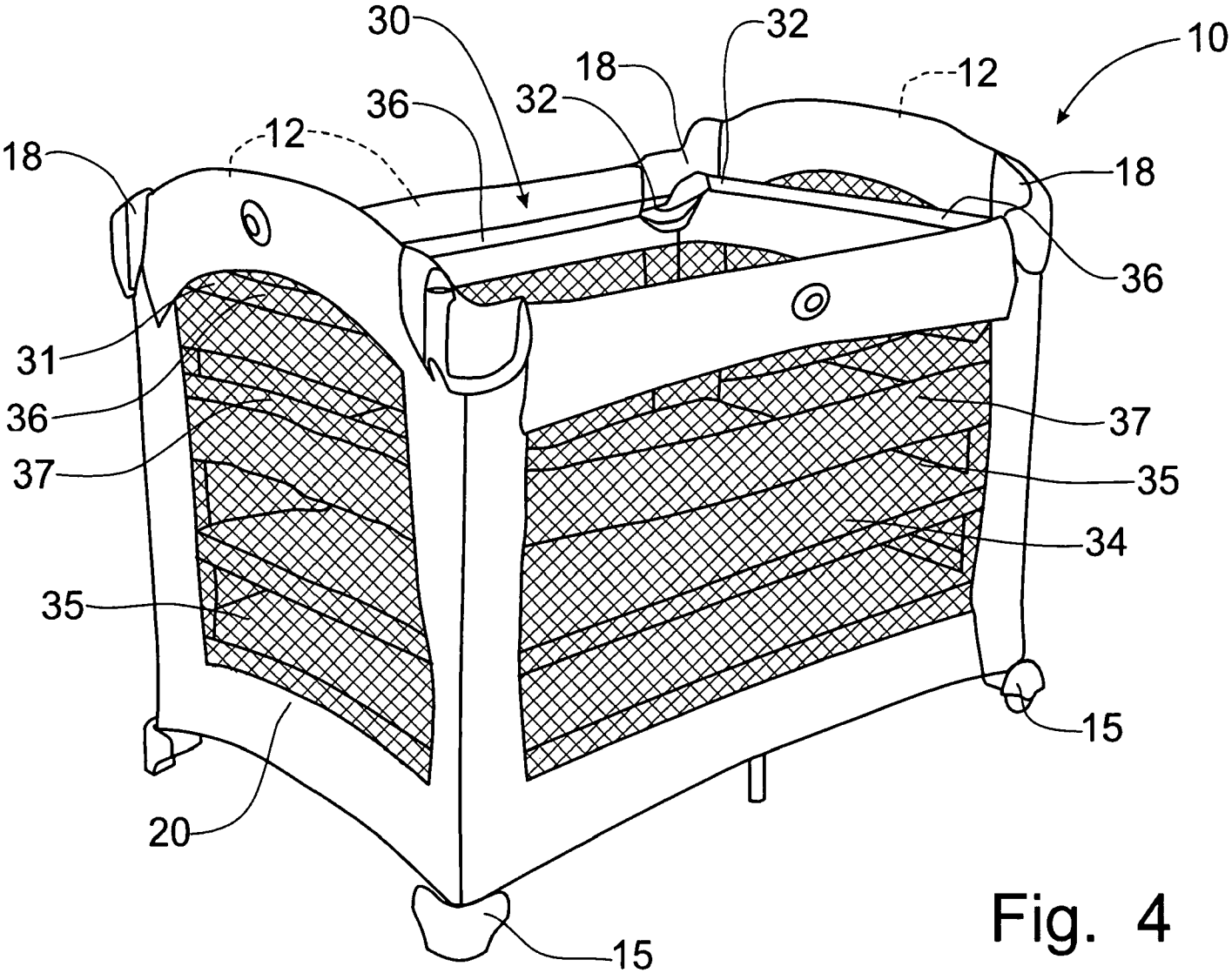
FIG. 4 is a perspective view of the play yard with the bassinet supported from the play yard frame structure at a lowermost position.
Figure 5:
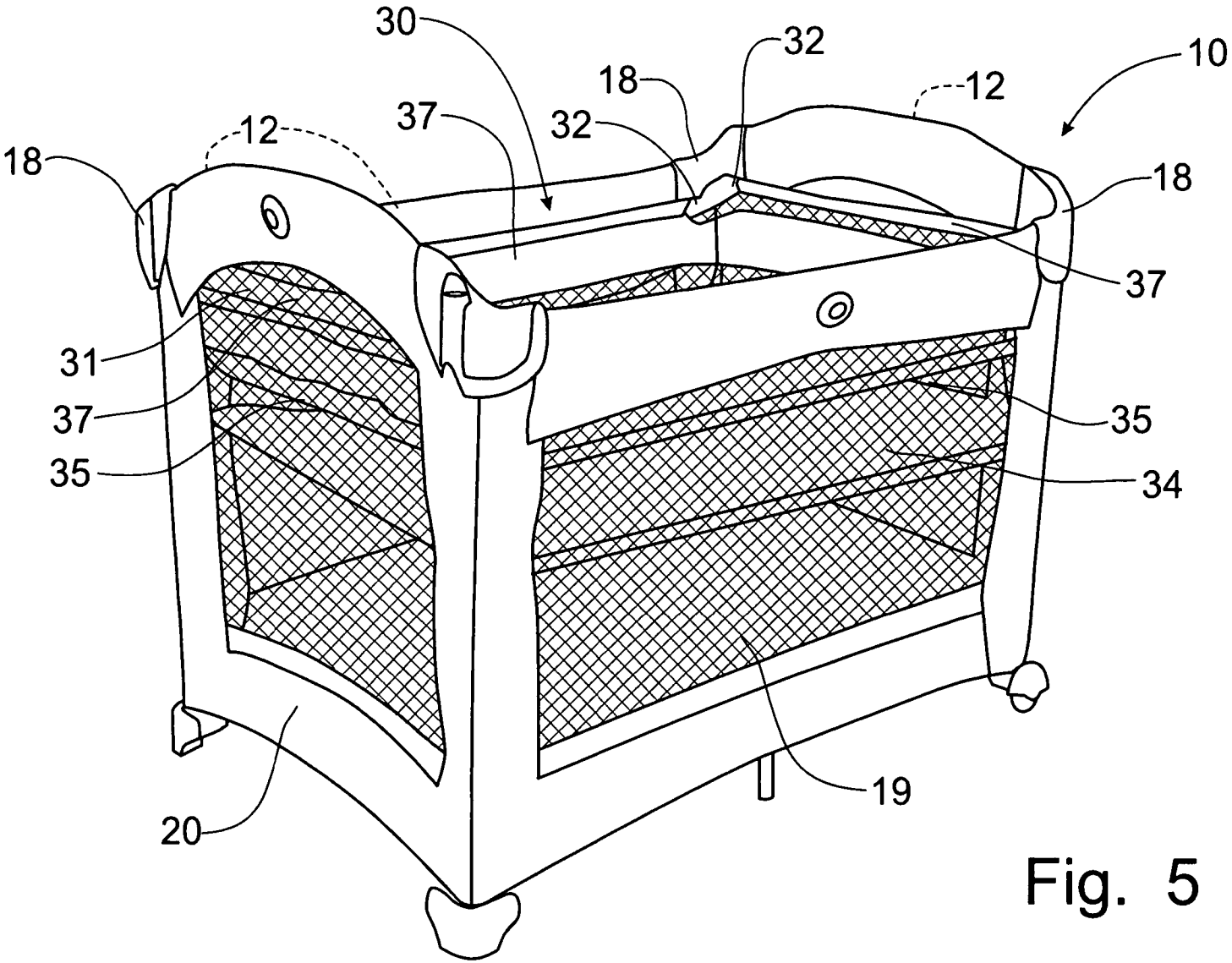
FIG. 5 is a perspective view of the play yard similar to that of FIG. 4, but showing the bassinet at a raised position.
Figure 6:
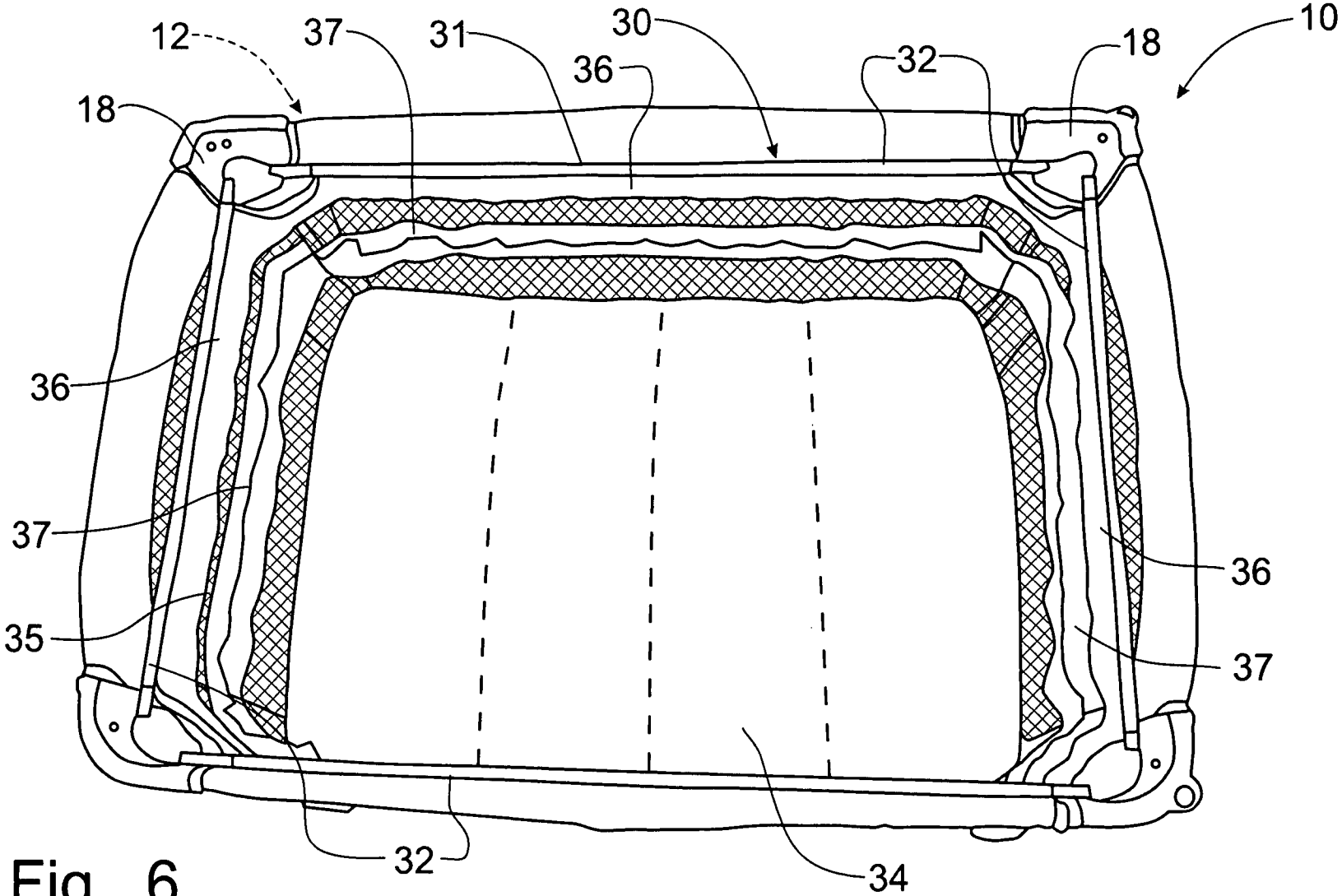
FIG. 6 is a perspective view of the bassinet structure with the side walls oriented to locate the floor portion of the bassinet at the lowermost position.

Referring now to FIGS. 4-6, the bassinet structure 30 can best be seen. The bassinet 30 is formed with its own frame 31, including upper support tubes 32 that define a rectangular frame 31, which are supportable from the frame structure 11 of the play yard 10. Preferably, the upper horizontal frame members 12 support caps 18 at the corners of the frame structure 11 which can be molded from plastic and used to connect the vertical frame members 14 to the upper horizontal frame members 12. The caps 18 are preferably formed with slots or ledges that are configured to support the upper support tubes 32 when engaged therewith. The bassinet 30 includes a horizontal bed 34 supported from the side walls 35 of the bassinet 30. Preferably, the side walls 35 are formed from mesh to facilitate viewing an infant placed on the bed 34.

One skilled in the art will recognize that the floor 19 of the play yard 10 is typically formed of a mattress-like pad mounted on a rigid support with a fabric panel extending between the side walls 35 below the rigid support. Typically, the mattress and support portion of the floor 19 is relocated into the bassinet 30 to create the bed 34, leaving the fabric panel portion of the floor 19, as the floor 19 of the play yard 10 cannot be used while the bassinet 30 is installed and utilized. Alternatively, the bed 34 of the bassinet 30 could be provided with its own bed structure 34 without requiring the mattress portion of the floor 19 to be relocated into the bassinet 30. Irrespective of the structure or the formation of the bed 34, the floor 19, or the remaining portion of the floor 19, is spaced vertically below the bed 34 to provide a more convenient and accessible support for the placement of an infant to sleep Preferably, the upper periphery of the side walls 35 is formed with primary fabric tunnels 36 sized to receive the upper support tubes 32 so that the side walls 35 can hang from the support tubes 32, which are supported on the caps 18. With the support tubes 32 positioned within the primary fabric tunnels 36, the bed 34 is located at the lowermost position from the upper frame members 12, yet above the floor 19 of the play yard 10. The side walls 35 are also preferably formed with at least one set of secondary fabric tunnels 37 positioned parallel to the primary fabric tunnels 36 between the primary fabric tunnels 36 and the bed 34. By positioning the upper support tubes 32 in the secondary fabric tunnels 37 and supporting the upper support tubes 32 on the caps 18, the bed 34 is raised to an elevated position that is closer to the upper frame members 12 than when in the lowermost position.

One skilled in the art will recognize that additional sets of secondary fabric tunnels 37 can provide a corresponding number of adjusted height positions for the bed 34. When the bassinet 30 is placed into an elevated position, the excess part of the side walls 35 extending between the primary fabric tunnels 36 and the secondary fabric tunnels 37 can be draped over the outside of the side walls 35 yet inside of the fabric body 20.

As an alternative configuration, the primary fabric tunnels 36 could be formed with detachable fastening devices, such as zippers, buttons, hook and loop fasteners or snaps, which are engagable with corresponding fastening devices on the side wall 35 below the primary fabric tunnels 36. For example, if corresponding fastening devices were placed on a strip of material positioned where the secondary fabric tunnels 37 are shown in FIGS. 4-6, and/or at the location of the bed 34, the side walls 35 could be looped over the upper support tubes 32 then the primary fabric tunnels 36 attached to the side walls 35 by the interconnection of the fastening devices and the corresponding fastening devices to shorten the side walls 35 and, thereby, elevate the position of the bed 34 relative to the lowermost position.

In operation, the bed 34 can be positioned at an elevated position by supporting the bassinet 30 with the upper support tubes 32 being located within the secondary fabric tunnels 37 and then supported on the caps 18. When the infant using the bassinet is older and has grown to be capable of rolling over, additional height to the side walls 35 would be desirable to locate the bed 34 at the lowermost position so that the infant cannot roll out of the bassinet 30. To accomplish this height adjustment for the bassinet, the caregiver will detach the upper support tubes 32 from the caps 18 and then withdraw the upper support tubes 32 from the secondary fabric tunnels 37. The upper support tubes 32 can then be inserted into the primary fabric tunnels 36 and re-mounted onto the caps 18 to increase the length of the side walls 35 and locate the bed 34 at the lowermost position. For the alternative configuration described above, the fastening devices would be disconnected to unwrap the side walls from being draped over the upper support tubes 32. Then, the upper support tubes 32 can be inserted into the primary fabric tunnels 36 and mounted on the caps 18.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A play yard comprising:

a main frame structure including upper horizontal frame members, lower horizontal frame members, and vertical frame members interconnecting the upper and lower horizontal frame members and defining vertical corners for the play yard;

a fabric body supported on the upper horizontal frame members and extending on an exterior of said main frame structure; and a bassinet structure selectively supportable from said main frame structure and including:

a bassinet frame structure including upper support tubes;

a bed positionable at a spaced relationship above said lower horizontal frame members;

vertical side walls extending around said bed, supporting said bed from said bassinet frame structure; and a height adjustment system to permit said bed to be located relative to said upper horizontal frame members between a lowermost position and at least one elevated position, said height adjustment system including a primary tunnel at an upper end of each said side wall and at least one secondary tunnel at an intermediate position between said primary tunnel and said bed.

2. The play yard of claim 1 wherein said upper support tubes are engaged with said primary tunnels to locate said bed at said lowermost position, said upper support tubes being engaged with a selected set of said secondary tunnels to locate said bed at said elevated position.

3. The play yard of claim 2 wherein said fabric body includes an attachment tab located at each respective said vertical corner, each attachment tab being engagable with a corresponding said foot member positioned at the lower terminus of each said vertical frame member to draw said fabric body down to said foot members.

4. In a play yard having a main frame structure including upper horizontal frame members, lower horizontal frame members, and vertical frame members interconnecting the upper and lower horizontal frame members and defining vertical corners for the play yard; and a fabric body supported on the upper horizontal frame members and extending on an exterior of said main frame structure; a floor member supported by said lower horizontal frame members; and a bassinet structure selectively supportable from said main frame structure and including a bassinet frame structure including upper support tubes, a bed positionable above said floor member, and vertical side walls extending around said bed, supporting said bed from said bassinet frame structure, the improvement comprising:

a height adjustment system permitting said bed to be located relative to said upper horizontal frame members between a lowermost position and at least one elevated position, said height adjustment system including a primary tunnel at an upper end of each said side wall and at least one secondary tunnel at an intermediate position between said primary tunnel and said bed.

5. The play yard of claim 4 wherein said upper support tubes are engaged with said primary tunnels to locate said bed at said lowermost position, said upper support tubes being engaged with a selected set of said secondary tunnels to locate said bed at said elevated position.

6. The play yard of claim 5 wherein each said vertical corner has a cap located at an upper terminus thereof, said upper support tubes being selectively engagable on said caps to support said bassinet from said main frame structure.

* * * * *